United States Patent [19]

Hruda

[11] 4,390,763

[45] Jun. 28, 1983

[54] ELECTROCHEMICAL CELL SHUNTING SWITCH ASSEMBLY WITH MATRIX ARRAY OF SWITCH MODULES

[75] Inventor: Robert M. Hruda, Horseheads, N.Y.

[73] Assignee: Westinghouse Electric Corp., Pittsburgh, Pa.

[21] Appl. No.: 267,823

[22] Filed: May 27, 1981

[51] Int. Cl.[3] ..... H01H 33/00; C25B 9/04

[52] U.S. Cl. ..... 200/144 B; 204/228; 204/253; 204/267; 204/279

[58] Field of Search ..... 204/228, 253–258, 204/267–270, 279; 200/144 B

[56] References Cited

U.S. PATENT DOCUMENTS

| | | | |
|---|---|---|---|
| 4,227,987 | 10/1980 | Kircher et al. | 204/228 |
| 4,251,334 | 2/1981 | Kircher | 204/228 X |
| 4,302,642 | 11/1981 | Hruda et al. | 200/144 B |
| 4,317,708 | 3/1982 | Specht et al. | 204/279 X |
| 4,324,634 | 4/1982 | Kircher et al. | 204/228 |

*Primary Examiner*—Donald R. Valentine
*Attorney, Agent, or Firm*—W. G. Sutcliff

[57] ABSTRACT

An electrical shunting switch assembly for use with a high continuous D.C. current electrochemical cell system, for electrically shunting or by-passing a cell of the system to permit maintenance or replacement, and then permitting stepped or gradual current diversion back through the cell. This shunting switch assembly includes a plurality of electrically parallel switch modules which comprises a vacuum switch, a series connected resistance value and switch operating means for sequentially operating the switches for current diversion. The switch modules are disposed in a matrix arrangement connected between bus connectors which are connectable across the cell, with switch modules having a low resistance value in alternating adjacent relationship to switch modules having a high resistance value. The low resistance value modules permit high shunting efficiency. The higher resistance value modules provide the capability for stepped or gradual current diversion.

5 Claims, 5 Drawing Figures

ELECTROCHEMICAL CELL SHUNTING SWITCH ASSEMBLY WITH MATRIX ARRAY OF SWITCH MODULES

CROSS-REFERENCE TO RELATED APPLICATION

This application is directed to a shunting switch assembly which utilizes switch modules as described and claimed in copending application filed herewith entitled, "Low D.C. Voltage, High Current Switch Assembly", Ser. No. 267,827, filed May 27, 1981 and owned by the assignee of the present invention.

BACKGROUND OF THE INVENTION

The present invention relates to an electrical switch assembly which is designed for low voltage, high continuous operating current, DC voltage operation. The switch assembly is adapted for use as a parallel path electrical shunt for use across the terminals of electrochemical cells, particularly for diaphragm type cells with operating currents of about 150,000 amperes or greater.

Such an electrochemical cell is discussed in U.S. Pat. No. 4,227,987, and a plurality of cells are typically provided in series with a constant current power supply. The shunt switch assembly is connectable across the terminals of an electrochemical cell to permit the cell to be isolated from the operating system for servicing or replacement without having to shut down the entire system. The shunt switch assembly should be an efficient current bypass device which can be operated to interrupt the very high current and to divert the system current back through the repaired cell.

It had been the practice in the industry to use electrical switches for such shunts or bypass switches which were knife edge contactors or similar air gap contacts. A recent innovation has been to use vacuum shorting switches in a bypass shunting switch assembly as described in U.S. Pat. No. 4,216,359. A multi vacuum switch shunting assembly designed for approximately simultaneous operation of the parallel connecting vacuum switches in described in U.S. Pat. No. 4,302,642 filed Aug. 24, 1977, entitled "Vacuum Switch Assembly," owned by the assignee of the present invention. In the aforementioned copending application generally tubular bus conductors of a predetermined resistance value extend from each vacuum switch to the cell terminals. These tubular bus conductors are closely spaced and aligned to minimize inductance. Another vacuum switch shunting assembly is described in copending application Ser. No. 154,153, filed May 28, 1980, now U.S. Pat. No. 4,370,530, entitled "Electrolytic Cell Electrical Shunting Switch Assembly," owned by the assignee of the present invention. The plurality of parallel connected vacuum switches in the aforementioned copending application each have a series connected resistor and are individually operable with a separate air cylinder.

It is desirable that a shunting switch assembly for use with an electrochemical cell be as compact as possible to minimize bus conductor material costs and inductance effects. The electrical switches of the assembly must be able to efficiently pass the bypass system current without overheating and without undue electrical losses. The electrical switches must be capable of diverting the system current back through the cell and to dissipate the interrupted arc current.

The continued operability and reliability of the switches of the jumper or bypass switch assembly when used with high current electrochemical cell systems is determined by the switch capability to dissipate during contact opening the stored inductive energy of the system. This energy, commonly in the range of 5,000 to 50,000 joules, can produce significant contact wear and erosion. For plural parallel connected bypass switch assemblies, the division of this energy among the plurality of parallel switches requires elaborate current equalizing bus work or great attention to attempts to adjust and synchronize the drive or operating mechanisms for the switches. It is very difficult if not impossible to effectively achieve synchronous switch operation in the needed 0.5 millisecond time scale for such mechanical drive operating systems.

SUMMARY OF THE INVENTION

The shunting switch assembly of the present invention utilizes a structure with a matrix of switch modules in which the switches operate sequentially, with an increasing portion of the system current being diverted through the bypassed cell. The switch assembly comprises a matrix array of low resistance switch elements and high resistance switch elements which permit high efficiency current bypass or shunting of the cell when the switches are closed. For current diversion, the low resistance switch elements are opened, and then the high resistance switch elements are opened in sequence to achieve the stepped current diversion from the shunting switch assembly to the cell. This sequential opening of the high resistance switch elements increases the overall shunting switch assembly resistance in a stepped fashion. The last to open high resistance switch element will only have to dissipate the greatly reduced remaining stepped current which is within the switch design energy dissipation capacity. Thus, no single switch contacts must interrupt more than a nominal, design current load, and this current is interrupted with little erosion and effect on switch life.

The matrix arrangement of a plurality of bus connectors and alternating adjacent low resistance switch elements with high resistance switch elements ensures low inductance interconnection and minimizes the stored inductive energy.

This matrix shunt switch assembly with a plurality of low resistance path switch modules in parallel with each other and with a plurality of higher resistance path switch modules provides significant energy cost savings for the operating cell system. The low resistance path switch modules permit high shunting efficiency with minimum electrical losses. While the higher resistance path switch modules provide the requisite capability to permit gradual current diversion during reconnection or start-up of the shunted cell. This gradual current diversion during cell start-up not only can have a beneficial effect on the membrane of the diaphragm cell, but also has the advantage of minimizing the energy that must be dissipated in the last-to-open switch module.

DESCRIPTION OF THE PREFERRED EMBODIMENTS

Figure 1:
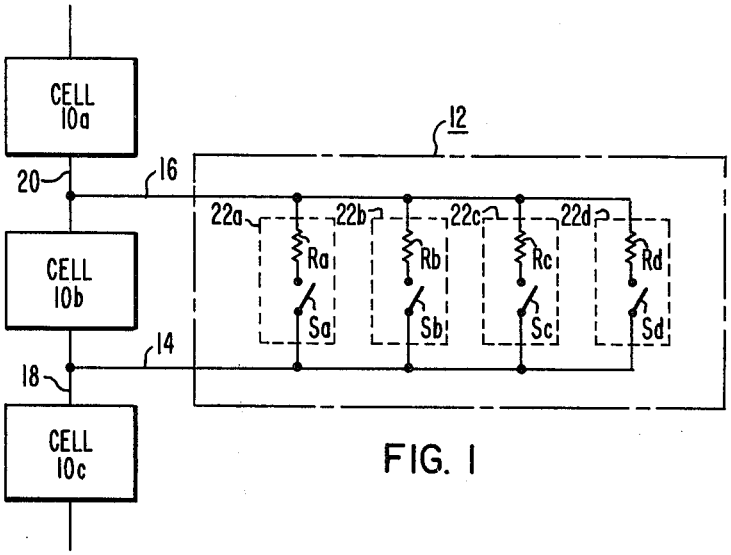
FIG. 1 is a schematic representation of an embodiment of a switch assembly of the present invention connected across the terminals of an electrochemical cell.

The invention can be best understood by reference to the embodiments seen in the drawings. In a schematic showing in FIG. 1, a plurality of serially electrically connected electrochemical cells 10*a*, 10*b* and 10*c* are seen. These cells are a few of many such cells of a system which is connected to a source of high D.C. current, which system and source are not shown. The cells are membrane or diaphragm-type chlor-alkali cells as are well known in the art.

A shunting switch assembly 12 or cell bypass switch assembly is defined by the dotted outline, and is electrically connectable in parallel to cell 10*b*, as a shunt or bypass for cell 10*b*. This shunting switch assembly 12 is connectable via first and second bus connectors 14 and 16 to respective opposed terminals 18 and 20 associated with the adjacent cells 10*a* and 10*c*. A plurality of switch modules 22*a*, 22*b*, 22*c*, 22*d* as depicted by the four dotted outlines within the overall switch assembly 12, are electrically connected between first and second bus connectors 14 and 16, as a plurality of electrically parallel branch paths. The switch modules 22*a*, 22*b*, 22*c*, 22*d* include a respective hermetically sealed, high D.C. continuous current rated switch Sa, Sb, Sc, Sd, with respective serially connected resistor element Ra, Rb, Rc, Rd. A separate operating mechanism for opening and closing an individual switch such as Sa is included with each module and described below in reference to FIGS. 2 and 3. The switches Sa are described in detail in U.S. Pat. No. 4,216,361, while the modules 22*a* are described in detail in copending application entitled "Low D.C. Voltage, High Current Switch Assembly", filed herewith as Ser. No. 267,827, filed May 27, 1981. The operating mechanism can be a two-way pneumatic cylinder operating means, the reciprocable rod of which is connected to one contact of the switch to open and close the switch contacts.

The switch modules 20*a* and 20*c* include low resistance means Ra and Rc, while modules 20*b* and 20*d* include high resistance means Rb and Rd. For example, Ra and Rc are water-cooled tubular copper members having a resistance value of less than about 10 micro-ohms, while Rb and Rd are water-cooled stainless steel tubular members having a relatively high resistance of about 100 micro-ohms. It is the relative difference between 10 and 100 micro-ohms which makes one low and the other a relatively high resistance.

The resistance values are selected such that the low resistor value provides a low enough resistance path for efficient shunting operation to minimize electrical losses and thermal heating of the switch modules. The high resistance value resistor is selected to provide the desired time frame for gradual or stepped current diversion during the start-up or reconnection of the shunted cell.

During normal cell bypass or shunting operation with all switches closed, the low resistance modules will essentially carry the shunt current. When it is desired to reconnect the cell 10*b* back to the cell system and to interrupt the shunt current to permit the shunting switch assembly to be disconnected from cell 10*b*, the low resistance modules are first opened, and thereafter the high resistance modules are sequentially opened to cause a stepped diversion of shunt current from the switch assembly back through the cell.

Figure 2:
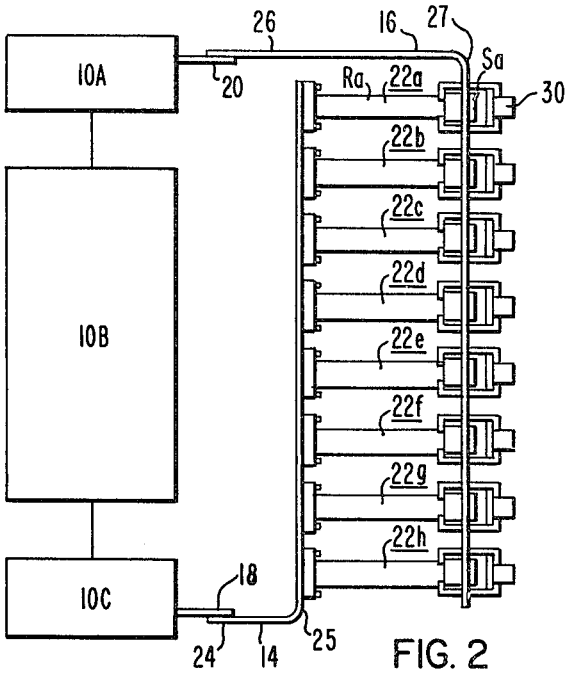
FIG. 2 is a top view of the matrix array switch assembly of the present invention.
Figure 3:
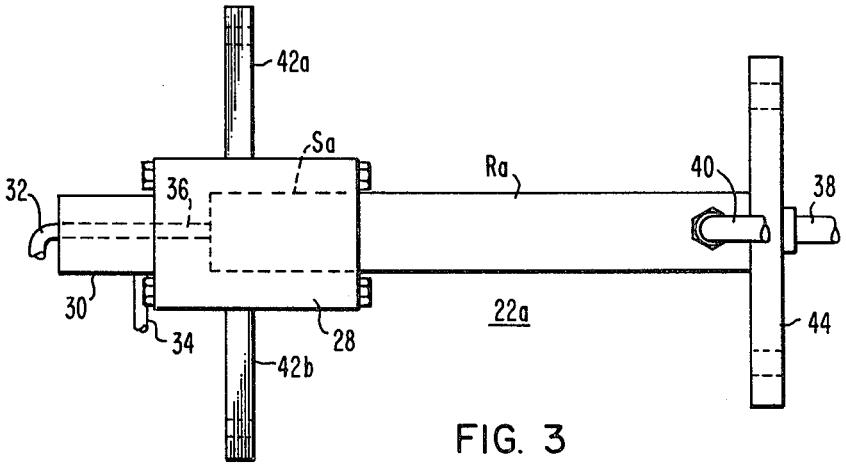
FIG. 3 is an enlarged view of a single switch module as used in FIG. 2 but viewed from the side.
Figure 4:
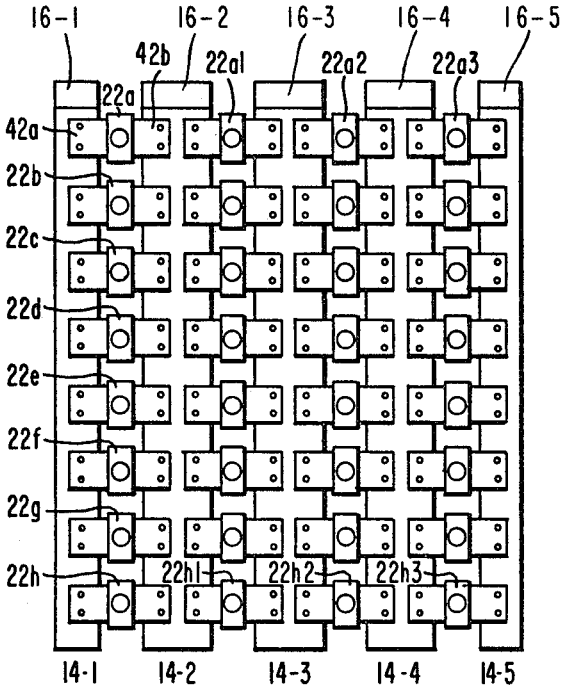
FIG. 4 is a side view of the embodiment of FIG. 2 looking toward the cell.

In the physical embodiment seen in FIGS. 2–4, the first and second bus connectors 14 and 16 are respectively seen as a plurality of closely spaced L-shaped planar bus conductors which are stacked in spaced-apart relationship with five pairs of conductors 14-1 through 14-5 making up the first bus connector 14 and five conductors 16-1 through 16-5 making up the second bus connector 16. A first transverse portion 24 of each of the L-shaped first bus conductors 14-1 through 14-5 extends transverse to the cell 10*b* and engages a cell terminal which extends transversely from adjacent cell 10*a*. The other portion 25 of L-shaped first bus conductors 41-1 through 14-5 extends in a direction parallel to the cell 10*b*. In like manner the second bus conductors 16-1 through 16-5 include a first transverse portion which is transverse to cell 10*b* and engages a terminal which extends transversely from adjacent cell 10*c*. The other portion 27 of the L-shaped second bus conductors 16-1 through 16-5 extends in a direction parallel to the cell 10*b* and to the portion 25 of conductors 14-1 through 14-5. The switch modules are connected between these parallel spaced apart portions 25 and 27 of the first and second bus conductors 14 and 16.

The structure of the matrix shunting switch assembly 12 is more easily understood from FIGS. 2 and 4, and particularly in FIG. 4. While from the top view of FIG. 2, only the uppermost bus conductor 14 and row or column of switch modules 22*a* through 22*h* are seen, in FIG. 4 it is seen that there are five stacked bus conductors 14-1 through 14-5 aligned in a common vertical plane. These bus conductors are spaced apart to receive switch modules between adjacent bus conductors. Between the five bus conductors, there are four columns of eight switch modules per column. In FIG. 4, a column includes eight switch assemblies 22*a* through 22*h*, a second column 22*a*1–22*h*1, and so fourth for the four columns.

The switch modules which are adjacent to each other in this matrix are of opposed resistance values, i.e., one is high resistance and the other low resistance. Thus, for example, if module 22*a* is low resistance, then modules 22*b* and 22*a*1 are high resistance, and module 22*b*1 is low resistance. The flexible bus connector means connects each switch module to the spaced bus conductors on each side of the module.

In like manner to the five stacked bus conductors 14-1 through 14-5, the other bus conductor 16 has five spaced-apart conductors 16-1 through 16-5 to which the other ends of the respective switch modules of the matrix are connected.

The switch module 22*a* is seen enlarged in greater detail in FIG. 3, which module is the subject of the above-mentioned copending application Ser. No. 267,827, filed May 27, 1981. The switch module 22*a* includes a hermetically sealed evacuated electrical switch Sa shown in phantom behind an insulating C-shaped linking member 28. The linking member 28 extends between the double-acting air cylinder operating means 30 having air connector 32 and air connector 34, and reciprocable operating rod 36 connected to one contact of the switch Sa. The tubular water-cooled resistor Ra is connected to the other side of switch Sa and to link member 28, with cooling fluid inlet 38 and outlet 40. Flexible bus connector portions 42*a*, 42*b* extend from opposed sides of the switch contact connected to the operating means 30 to permit connection of the switch module 22*a* to the spaced-apart bus conductors 14-1 and 14-2. A flange connector 44 is provided at the other end of resistor Ra to permit connection of the switch module 22*a* to the bus conductors 16-1 and 16-2.

In this embodiment with five spaced-apart first and second bus connectors, the switch modules are disposed in a matrix array as best seen in FIG. 3, with eight rows of four modules to a row. The switch modules are connected at one switch contact by flexible connector means to adjacent first bus connectors. The tubular resistive elements, which are typically water cooled are connected to the other switch contact of respective modules, and are then connected to the adjacent second bus connectors. By matrix array is meant the rows and columns of modules between the spaced-apart first and second bus connectors. Each high resistance switch module has adjacent to it a low resistance switch module, so that a checkerboard-like matrix of modules distributes the shunted current, and does so with a minimum inductance for the shunting switch assembly.

In this embodiment, there are 32 switch modules, with 16 being low resistance modules which efficiently carry the shunt current during cell bypass operation. The other 16 high resistance modules serve as the sequential current diversion mechanism after the 16 low resistance modules are initially opened. The time between switch opening for the high resistance modules can be varied to quickly achieve current diversion back through the cell for operating efficiency, or a desired dwell time between switch openings can be effected for controlled, low current start-up as set forth in U.S. Pat. No. 4,251,334.

When all 32 switches are closed the cell system current is substantially carried by the 16 low resistance path switches, which is during full shunt operation. When it is desired to divert the shunt current back through the bypassed or shunted cell, the 16 low resistance path switches are opened. The 16 high resistance path switches in parallel present a controlled high current path which will cause a small portion of the shunt current to be diverted back through the parallel cell path. The 16 high resistance path switches are then opened in time-controlled sequence to divert an increasing portion of the system current back through the cell.

An individual switch module 22*a* is best seen in FIG. 3. The electrical switch Sa is a hermetically sealed device which is evacuated, and the contacts are separable within the vacuum to effect current interruption when it is desired to divert the current back through the cell. Such vacuum electrical switch is described in detail in U.S. Pat. No. 4,216,361. The switch Sa has a flexible diaphragm envelope portion to permit reciprocal movement of the cylindrical contacts which extend through the hermetically sealed envelope. A first switch contact is connected via a flexible bus link to adjacent first bus conductors. The second switch contact is rigidly connected to the tubular resistive element Ra, and also is rigidly connected via insulating C-shaped link means to the body of the air cylinder operating means.

There is an individual operating means associated with each switch. The operating means is typically a double acting pneumatic cylinder which provides a reciprocal acting drive rod force connected to one contact of the switch to open and close the contacts within the switch.

The low and high resistance means are tubular water-cooled bodies connected to the other switch contact with intimate contact between the water-cooled terminal of the resistance means and the switch contact providing the cooling capacity to rate the switch module at 12.5 KA D.C. continuous current.

Figure 5:
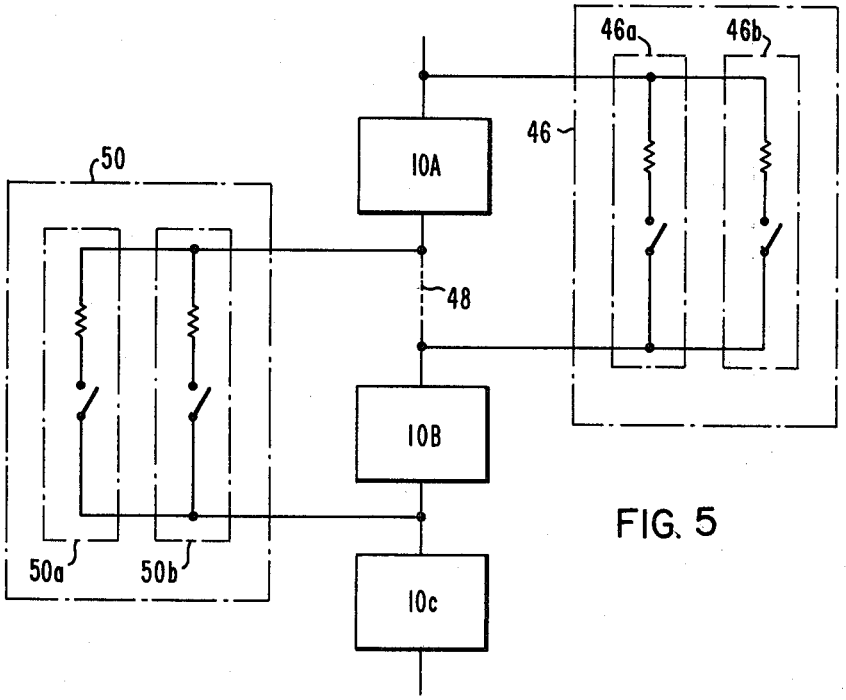
FIG. 5 is another circuit schematic representation of a system using the switch assembly of the present invention.

FIG. 5 is a circuit schematic illustrating another cell shunting system in which two separate matrix shunting switch assemblies per the present invention are used to first bypass or shunt a cell of the system, and are then used to gradually start-up a replacement cell which is substituted for the shunted cell. This type of cell bypass and start-up system is suggested in U.S. Pat. No. 4,251,334. The matrix shunting switch assemblies of the present invention provide a convenient and efficient shunt bypass switch as well as a variable resistance current diversion switch assembly for cell start-up or reconnection.

A first switch assembly 46 is shown connected in parallel to cell 10*a* and with removable link conductor 48 removed, the switch assembly 46 is in series with cell 10*b*. The first switch assembly 46 is shown made up of only two switch modules 46*a*, 46*b* for purposes of illustration only. There would in fact be a matrix of switch modules as seen in FIG. 4, with the number of switch modules being designed to provide the necessary current rating. A second switch assembly 50 is shown in parallel with cell 10*b* which is the cell to be repaired or replaced and is thus to be shunted. This second switch assembly 50 serves as a shunting means around cell 10*b* when link conductor 50 is removed. The second switch assembly 50 likewise is shown with only two switch modules 50*a* and 50*b* to illustrate the system, but in fact a matrix of switch modules as seen in FIG. 4 would be physically present to provide the desired current rating. The first switch assembly 46 can thereafter be used as the current diversion means for directing a predetermined portion of the current back through cell 10*b*. Both of the switch assemblies 46 and 50 are of the matrix switch assembly structure which comprises the present invention. When current is to be fully diverted back through cell 10*b*, the link 48 is put in place between cell 10*a* and cell 10*b* and the switch assemblies 46 and 50 are removed for use at another cell.

The present invention has been illustrated by the embodiments seen in FIGS. 2 and 4 with 32 switch modules and 5 rows of bus conductors. The matrix array is easily varied in terms of the number of parallel bus conductors and the number of switch modules which are designed to provide the desired current rating for the switch assembly.

I claim:

1. An electrochemical cell shunting switch assembly which is connectable to the terminals of adjacent series connected electrochemical cells to provide an efficient high current capacity shunt path around the shunted cell, and to permit diversion of the shunt current back through the shunted cell in a predetermined time dependent manner, wherein the shunting switch assembly comprises:

(a) first and second bus connectors, the first bus connector connectable at one end to a terminal of a cell adjacent to the cell to be shunted, and the second bus connector connectable at one end to a terminal of another cell adjacent to the cell to be shunted, with the other ends of the first and second bus connectors being disposed in spaced apart parallel planes;

(b) a matrix array of a plurality of parallel switch modules connectable between the first and second bus connectors, which matrix array includes a plurality of shunt path switch modules and a plurality of current diversion switch modules, each of which shunt path switch modules comprise a switch means having contacts which are relatively reciprocable to open and close the switch contacts, with one switch contact serially connected to selected low resistance means to one of the bus connectors, and the other switch contact is connected by flexible connection means to the other bus connector, with individual operating means connected to the switch contact connected to the flexible connector means for opening and closing the switch contacts, which low resistance means is selected to provide a high efficiency shunt current path; and (c) each of which current diversion modules comprises a switch means and operating means as described above and a selected high resistance means is serially connected to one switch contact and to one of the bus connectors, which high resistance means is selected such that when the shunt path modules are opened a selected portion of the shunt current is diverted back through the shunted cell, and with sequential opening of individual current diversion modules to increase the diverted current back through the cell until with the opening of the last current diversion module all of the current has been diverted back through the previously shunted cell.

2. The shunting switch assembly set forth in claim 1, wherein the matrix array of parallel switch modules comprises shunt path switch modules with current diversion switch modules in rows and columns between the first and second bus connectors, with adjacent switch modules alternately being shunt path switch modules and current diversion switch modules.

3. The shunting switch assembly set forth in claim 1, wherein the first and second bus connectors each comprise a plurality of spaced apart planar conductors, with the planar conductors of the first bus connector aligned in a generally common planar stack, and the planar conductors of the second bus connector aligned in another generally common planar stack which is spaced apart from and parallel to the first bus connectors, and the matrix array of electrically parallel connected switches is connected between the spaced apart first and second bus connectors.

4. The shunting switch assembly set forth in claim 1, wherein the shunt path switch module serially connected low resistance means is about 10 micro-ohms, and the current diversion switch module high resistance means is about 100 micro-ohms.

5. The shunting switch assembly set forth in claim 1, wherein the shunt path switch module serially connected low resistance means is about 10 micro-ohms, and the current diversion switch module high resistance means is selected to provide the desired current diversion characteristic.

* * * * *